US006257833B1

(12) United States Patent
Bates

(10) Patent No.: US 6,257,833 B1
(45) Date of Patent: Jul. 10, 2001

(54) REDUNDANT, DEDICATED VARIABLE SPEED DRIVE SYSTEM

(75) Inventor: Brendan J. Bates, Aurora, IL (US)

(73) Assignee: Metropolitan Industries, Inc., Romeoville, IL (US)

( * ) Notice: Subject to any disclaimer, the term of this patent is extended or adjusted under 35 U.S.C. 154(b) by 0 days.

(21) Appl. No.: 09/478,119

(22) Filed: Jan. 4, 2000

(51) Int. Cl.[7] ..... F04B 41/06

(52) U.S. Cl. ..... 417/4; 417/5; 417/17; 417/28

(58) Field of Search ..... 417/4, 5, 6, 16, 417/28, 17

(56) References Cited

U.S. PATENT DOCUMENTS 3,511,579 * 5/1970 Gray et al. ..... 417/6
4,527,681 * 7/1985 Sommer ..... 192/52
5,120,201 * 6/1992 Tuckey et al. ..... 417/366
5,522,707 6/1996 Potter ..... 417/4

FOREIGN PATENT DOCUMENTS 60-263771-A * 12/1985 (JP) ..... 417/4
63-302199-A * 12/1988 (JP) ..... 417/4
08-200232-A * 8/1996 (JP) ..... 417/4

* cited by examiner

*Primary Examiner*—Cheryl J. Tyler
(74) *Attorney, Agent, or Firm*—Rockey, Milnamow & Katz, Ltd.

(57) ABSTRACT

A redundant, modular pump system includes a plurality of substantially identical pump modules. Each module includes constant speed drive circuitry, variable speed drive circuitry and a pump. Expansion is accomplished by adding modules. Reliability is enhanced by being able to operate each pump at constant or variable speed irrespective of whether other modules are being operated at different variable or constant speeds. A common, software driven control element activates drives and other devices in the modules to provide fluid on demand at a pre-selected pressure.

13 Claims, 1 Drawing Sheet

REDUNDANT, DEDICATED VARIABLE SPEED DRIVE SYSTEM

FIELD OF THE INVENTION

The invention pertains to variable speed pump drive systems. More particularly, the invention pertains to such systems wherein a variable speed drive system is coupled to each pump.

BACKGROUND OF THE INVENTION

Multiple pump fluid delivery systems which incorporate a variable speed drive system, switchable between pumps are known. One such system is disclosed in Potter U.S. Pat. No. 5,522,707 entitled "Variable Frequency Drive System for Fluid Delivery System" assigned to the assignee hereof. The disclosure of the Potter patent is hereby incorporated by reference. The benefits of combining pumps being driven at constant speed with one being driven by a variable speed drive are known.

While useful for their intended purpose, known systems suffer from a lack of redundancy with respect to the variable speed drive. In such systems, in the event of a failure in the variable speed drive, all of the pumps must be run at constant speed and the respective pressure regulator valves relied on to deliver fluid at the preset pressure. This is a less energy efficient mode of operation.

For reasons of energy efficieny, it would be desirable, in the event of a failure of a variable speed drive, to be able to continue, in some way to vary the speed of at least some of the pumps. Preferably such functionality could be incorporated into multiple pump systems to provide both redundancy and operational flexibility.

Additionally, multiple pump fluid delivery systems which incorporate multiple variable frequency drive systems and by-pass constant-speed contactors, each dedicated to a particular pump on the system are known. The benefits of combining pumps, each being driven by an independent variable speed drive and by-pass constant-speed contactor are also known. These known systems do not incorporate pressure regulator valves to permit a preselected output pressure to be maintained.

While useful for their intended purpose, known systems suffer from a lack of redundancy with respect to the variable frequency drive. In such systems, in the event of a failure of one of the variable frequency drives, the pump with the failed drive must operate at constant-speed, and because there is no pressure regulating valve, there is then no means of delivery of the pumped fluid at the preset pressure.

It would be desirable, in the event of a variable speed drive failure, to be able in some way to run the pump with the variable speed drive failure in the constant-speed mode, while continuing to deliver the pumped fluid at the preset pressure. Preferably such functionality could be incorporated into multiple pump systems to provide both redundancy and operational flexibility.

SUMMARY OF THE INVENTION

A multi-pump control system includes a plurality of pump modules. Each module includes a variable speed drive and a constant speed drive coupled to a pump. Each module includes a pressure regulating valve which can be disabled by a remotely generated control signal which allows the variable speed drive to operate correctly and efficiently.

The use of standardized modules promotes ease of expansion while at the same time it reduces manufacturing and maintenance overhead.

A control unit is coupled to all of the modules. The control unit also receives output pressure feedback. In response to demand, the control unit actuates one or more of the pumps to provide fluid on demand at a preset pressure.

To minimize wear, the control unit can assign a lead pump function to available pumps on a rotating basis. Each pump can be driven by either the respective variable speed drive or the respective constant speed drive depending on its currently assigned function. Variable speed is preferable. Constant speed operation is intended to be for standby operation.

In the event that the respective variable speed drive fails, that pump can be driven using the constant speed drive. The remaining pumps can be driven by their respective variable speed drives. This redundancy provides continued flexibility and makes possible continued variable response to fluid demand. As a result, in an n pump system, (n−1) variable speed drives can fail, and the system will be able to function with a combination of variable speed and constant speed drives.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
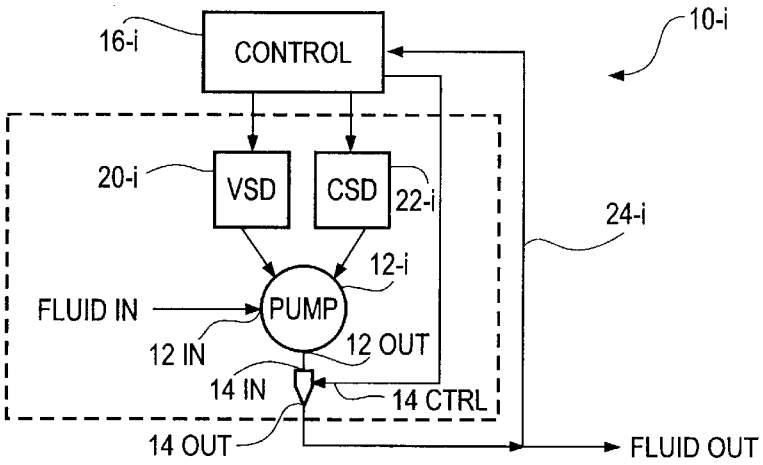
FIG. 1 is a block diagram of a multi-drive pump module.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a pump system module 10-*i*. The module 10-*i* includes a pump 12-*i*, and associated pressure regulating valve 14-*i* (PRV). The module also includes a variable speed drive 20-*i* and a constant speed drive 22-*i*.

A control element 16-*i* which need not be part of module 10-*i* is coupled to drives 20-*i* and 22-*i*.

It will be understood that the details of the control element 16-*i*, variable speed drive 20-*i* and constant speed drive 22-*i* are not limitations of the present invention. The details of the interconnections of the two drives to pump 12-*i* are not a limitation of the present invention.

Pump 12-*i* includes a fluid input port 12in and an output port 12out. Pressure regulating valve 14-*i* includes an input port 14in, an output port 14out and a solenoid control input port 14ctrl. This control port, as is known, can be used to enable or disable operation of the respective valve. A feedback loop 24-*i* couples output pressure to the control element 16-*i*.

The control element 16-*i* can actuate either the variable speed drive 20-*i* or the constant speed drive 22-*i* in response to demand for fluid. Module 10-*i* provides an enhanced level of operational redundancy in that if one drive fails the other can continue to energize the pump.

For each of the pump modules, such as module 10-*i*, when using the respective variable speed drive 20-*i* to energize the pump 12-*i*, the respective pressure regulating valve 14-*i* is disabled. When using the respective constant speed drive 22-*i*, which could include a set of relay contacts, to apply a voltage to the respective pump 12-*i*, the respective pressure regulating valve 14-*i* is enabled.

Figure 2:
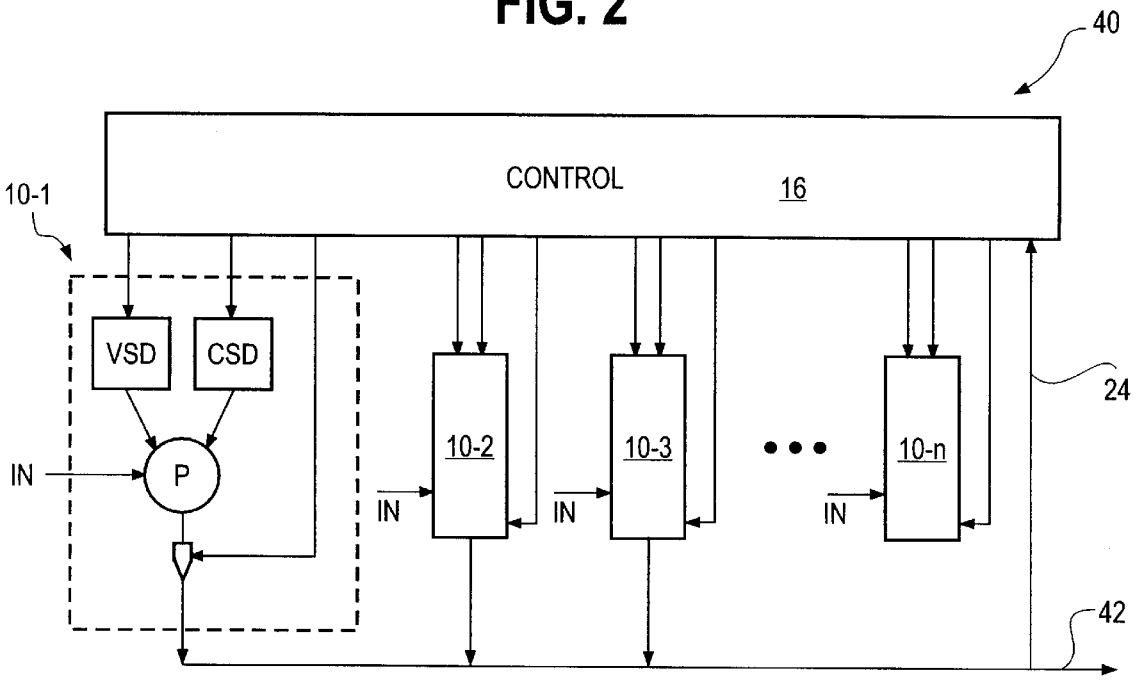
FIG. 2 is a block diagram of a system which incorporates a plurality of modules as in FIG. 1.

FIG. 2 illustrates a system 40 which incorporates a plurality of modules 10-1, 10-2, 10-3 . . . 10-n each of which corresponds to module 10-*i*. The modules are in turn coupled to a control element 16.

Each of the pumps has a respective input port, such as the port 12in. All of the input ports are coupled to a fluid source. All of the output ports, such as the port 14out are coupled together to provide a regulated output at an output conduit 42.

The control element 16 is also coupled to each of the solenoid control input ports, such as the port 14ctrl of the respective PRV. While each of the valves 14-*i* can be set to a selected output pressure, as an alternate, each valve's setpoint can be adjusted by the control element 16. Feedback to control element 16 is provided via line 24.

System 40 provides an enhanced level of redundancy wherein any pump can be run off of either respective, dedicated variable speed drive circuitry or constant speed drive circuitry. Hence, if the variable speed drive circuitry of one module fails, variable speed drive circuitry in the remaining modules can be used to drive the respective pumps. The module with the failed variable speed drive circuitry can be run off of the constant speed drive circuitry with precise pressure control.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A redundant, modularly expandable pump system comprising:

a plurality of substantially identical pump modules; and a control element coupled to the modules wherein the modules each include:

a pump;

variable speed drive circuitry coupled to the pump; and constant speed drive circuitry coupled to the pump;

wherein the control element includes circuitry for selecting one of the variable speed and constant speed drive circuitry for each module.

2. A system as in claim 1 wherein fluid capacity is increased by adding another module to the plurality of pump modules and coupling the additional module to the control element.

3. A system as in claim 2 wherein at least some of the modules include a pressure regulating valve with a control input and wherein the valve is coupled to an output port of a respective pump.

4. A system as in claim 3 wherein the control element is coupled to each of the valve control inputs.

5. A system as in claim 4 wherein the control element includes circuitry for disabling a respective valve while the respective variable speed drive is being actuated.

6. A system as in claim 4 wherein the control element includes circuitry for adjusting a set point setting of at least one of the valves.

7. A system as in claim 1 wherein each of the pumps has a fluid input port and a fluid output port and wherein the output ports are coupled to a common output conduit.

8. A system as in claim 7 which includes a pressure sensor coupled between the output conduit and the control element.

9. A system as in claim 1 wherein the control element includes a programmed processor and executable instructions for assigning a lead pump function to a selected pump module and for actuating the respective variable speed drive in accordance therewith.

10. A system as in claim 9 wherein in response to a detected failure of a variable speed drive, in a module, the processor executes instructions which activate the constant speed drive circuitry in that module to energize the respective pump.

11. A system as in claim 10 wherein the processor executes instructions to activate variable speed drive circuitry of a different module than the module exhibiting the detected failure.

12. A module for a fluid pumping system comprising:

a pump with fluid input and output ports and an electrical input port;

a pressure regulating valve coupled to the fluid output port;

dedicated variable speed drive circuitry, with an input port and an output port wherein the output port of the circuitry is coupled to the electrical input port of the pump and is not reassignable to a different module;

dedicated constant speed drive circuitry; and wherein the drive circuitry includes control input ports for selecting therebetween.

13. A module as in claim 12 wherein the valve has an electrical control input.

* * * * *